US010144899B2

(12) United States Patent
Suetsugu

(10) Patent No.: US 10,144,899 B2
(45) Date of Patent: Dec. 4, 2018

(54) VISCOSITY INDEX IMPROVER, LUBRICANT COMPOSITION, AND METHOD FOR PRODUCING LUBRICANT COMPOSITION

(71) Applicant: IDEMITSU KOSAN CO., LTD., Chiyoda-ku (JP)

(72) Inventor: Yoshiyuki Suetsugu, Kisarazu (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/316,881

(22) PCT Filed: Mar. 16, 2016

(86) PCT No.: PCT/JP2016/058338
§ 371 (c)(1),
(2) Date: Dec. 7, 2016

(87) PCT Pub. No.: WO2016/152679
PCT Pub. Date: Sep. 29, 2016

(65) Prior Publication Data

US 2017/0096616 A1 Apr. 6, 2017

(30) Foreign Application Priority Data

Mar. 20, 2015 (JP) ..... 2015-058353

(51) Int. Cl.
*C10M 171/00* (2006.01)
*C10M 143/10* (2006.01)
*C10M 145/14* (2006.01)

(52) U.S. Cl.
CPC ..... *C10M 143/10* (2013.01); *C10M 145/14* (2013.01); *C10M 171/00* (2013.01); *C10M 2203/10* (2013.01); *C10M 2203/1006* (2013.01); *C10M 2203/1025* (2013.01); *C10M 2205/04* (2013.01); *C10M 2207/026* (2013.01); *C10M 2207/144* (2013.01); *C10M 2207/262* (2013.01); *C10M 2209/084* (2013.01); *C10M 2215/064* (2013.01); *C10M 2215/086* (2013.01); *C10M 2215/28* (2013.01); *C10M 2223/045* (2013.01); *C10M 2229/02* (2013.01); *C10N 2220/021* (2013.01); *C10N 2220/022* (2013.01); *C10N 2220/028* (2013.01); *C10N 2230/02* (2013.01); *C10N 2230/54* (2013.01); *C10N 2230/68* (2013.01); *C10N 2240/10* (2013.01)

(58) Field of Classification Search
CPC ..... C10M 143/10; C10M 145/14; C10M 2203/10; C10M 2205/04; C10M 2209/084; C10M 2207/144; C10M 2215/086; C10M 2223/045; C10M 2215/064; C10M 2229/02; C10N 2230/02; C10N 2220/022; C10N 2220/021
See application file for complete search history.

(56) References Cited

U.S. PATENT DOCUMENTS

| | | | | |
|---|---|---|---|---|
| 5,565,130 | A | 10/1996 | Omeis et al. | |
| 5,756,433 | A * | 5/1998 | Auschra | C10M 145/14 508/469 |
| 2001/0053752 | A1 | 12/2001 | Miyanaga et al. | |
| 2008/0194443 | A1 | 8/2008 | Stohr et al. | |
| 2010/0190671 | A1* | 7/2010 | Stoehr | C08F 290/04 508/469 |
| 2016/0010023 | A1 | 1/2016 | Matthews et al. | |

FOREIGN PATENT DOCUMENTS

| | | | |
|---|---|---|---|
| EP | 0 621 293 | | 10/1994 |
| JP | 6-306130 | A | 11/1994 |
| JP | 8-311133 | A | 11/1996 |
| JP | 9-40986 | A | 2/1997 |
| JP | 2002-105435 | A | 4/2002 |
| JP | 2007-217494 | A | 8/2007 |
| JP | 2014-210844 | A | 11/2014 |
| WO | 2013/189951 | | 12/2013 |
| WO | 2014/135628 | A1 | 9/2014 |

OTHER PUBLICATIONS

International Search Report dated Jun. 21, 2016 in PCT/JP2016/058338 filed Mar. 16, 2016.
Extended European Search Report dated Jul. 4, 2018, in the corresponding European patent application EP 16768582.

* cited by examiner

*Primary Examiner* — Taiwo Oladapo
(74) *Attorney, Agent, or Firm* — Oblon, McClelland, Maier & Neustadt, L.L.P.

(57) ABSTRACT

A viscosity index improver including a comb-shaped polymer is provided. For a solution having the viscosity index improver dissolved in a mineral oil and having a solid component concentration of 25 mass %, a ratio of the storage modulus (G') to the loss modulus (G") of the solution measured at a measuring temperature of 70° C. is 0.40 or more. For a solution (α) at 25° C. having the viscosity index improver dissolved in a mineral oil and having a solid component concentration of 25 mass % and a solution (β) resulting from subjecting the solution (α) to heating to 100° C. at a prescribed temperature rise rate and then cooling to 25° C. at a prescribed cooling rate, a ratio of the storage modulus (G') of the solution (β) to the storage modulus (G') of the solution (α) measured at a measuring temperature of 25° C. is 2.0 or more.

23 Claims, No Drawings

VISCOSITY INDEX IMPROVER, LUBRICANT COMPOSITION, AND METHOD FOR PRODUCING LUBRICANT COMPOSITION

CROSS-REFERENCE TO RELATED APPLICATIONS

This application is a National Stage of PCT/JP2016/058338, which was filed on Mar. 16, 2016. This application is based upon and claims the benefit of priority to Japanese Application No. 2015-058353, which was filed on Mar. 20, 2015.

TECHNICAL FIELD

The present invention relates to a viscosity index improver, a lubricating oil composition containing the viscosity index improver together with a base oil, and a method for producing the lubricating oil composition.

BACKGROUND ART

In recent years, an improvement in fuel consumption performance of vehicles, such as automobiles, etc., is a big problem, and as one means for solving that problem, an improvement in fuel consumption reducing properties of a lubricating oil composition is demanded.

As a measure for improving the fuel consumption reducing properties of a lubricating oil composition, the development of a lubricating oil composition that may reduce friction between mechanical parts or a lubricating oil composition having reduced viscous resistance is performed. As for an additive capable of reducing the viscous resistance of a lubricating oil composition, the development and selection of a viscosity index improver are widely performed.

From the viewpoint of an improvement in fuel consumption reducing properties of a lubricating oil composition, for example, polymethacrylate-based viscosity index improvers have hitherto been used for engine oil.

For example, PTL 1 discloses a lubricating oil composition for internal combustion engine, in which an ashless dispersant, a polymethacrylate-based viscosity index improver whose PSSI (permanent shear stability index) falls within a predetermined range, and the like are contained in a lubricating base oil, and a ratio of a viscosity index to an HTHS viscosity (high temperature high shear viscosity) at 100° C. is regulated to a predetermined range.

It is mentioned that the lubricating oil composition for internal combustion engine described in PTL 1 is good in fuel consumption reducing properties in a high-temperature region.

In addition, PTL 2 discloses a lubricating oil composition for internal combustion engine, in which a comb-shaped polymer having a specified weight average molecular weight and including a repeating unit based on a polyolefin macromonomer, a repeating unit based on an alkyl (meth) acrylate, and a repeating unit based on a styrene-based monomer in a main chain thereof is contained as a viscosity index improver in a base oil, the lubricating oil composition having a predetermined viscosity index.

It is mentioned that the lubricating oil composition for internal combustion engine described in PTL 2 has excellent coking resistance and shear stability while having a high viscosity index.

CITATION LIST

Patent Literature

PTL 1: JP 2007-217494 A
PTL 2: JP 2014-210844 A

SUMMARY OF INVENTION

Technical Problem

However, the lubricating oil compositions containing a viscosity index improver as described PTLs 1 and 2 are not sufficient from the viewpoint of fuel consumption reducing properties. A viscosity index improver that makes it possible to more improve the fuel consumption reducing properties of a lubricating oil composition is demanded.

An object of the present invention is to provide a viscosity index improver capable of more improving a fuel consumption reducing properties while making various properties of a lubricating oil composition favorable, a lubricating oil composition containing the viscosity index improver together with a base oil, and a method for producing the lubricating oil composition.

Solution to Problem

The present inventor found that with respect to a viscosity index improver containing a comb-shaped polymer, as it has a structure whose degree of entanglement between molecules is large, a change in viscosity attributable to a temperature environment or a change in temperature is small, and an effect for improving a fuel consumption reducing properties of a lubricating oil composition is high. The present invention has been accomplished on a basis of this finding.

Specifically, the present invention is to provide the following [1] to [4].

[1] A viscosity index improver containing a comb-shaped polymer and satisfying the following requirement (I):

Requirement (I): with respect to a solution having the viscosity index improver dissolved in a mineral oil and having a solid component concentration of 25 mass %, a ratio [(G')/(G")] of a storage modulus (G') to a loss modulus (G") of the solution as measured under conditions of a measuring temperature of 70° C., an angular frequency of 100 rad/s, and a strain of 20% is 0.40 or more.

[2] A viscosity index improver containing a comb-shaped polymer and satisfying the following requirement (II):

Requirement (II): with respect to a solution (α) at 25° C. having the viscosity index improver dissolved in a mineral oil and having a solid component concentration of 25 mass % and a solution (β) resulting from subjecting the solution (α) to temperature rise to 100° C. at a temperature rise rate of 0.2° C./s and then cooling to 25° C. at a cooling rate of 0.2° C./s, a ratio [solution (β)/solution (α)] of a storage modulus (G') of the solution (β) as measured under conditions of a measuring temperature of 25° C., an angular frequency of 100 rad/s, and a strain of 1% to a storage modulus (G') of the solution (α) as measured under conditions of a measuring temperature of 25° C., an angular frequency of 100 rad/s, and a strain of 20% is 2.0 or more.

[3] A lubricating oil composition containing the viscosity index improver as set forth above in [1] or [2] together with a base oil.

[4] A method for producing a lubricating oil composition including a step of blending a base oil with the viscosity index improver as set forth above in [1] or [2].

Advantageous Effects of Invention

In the case where the viscosity index improver of the present invention is blended together with a base oil to prepare a lubricating oil composition, it is possible to more improve a fuel consumption reducing properties while making various properties of the lubricating oil composition favorable.

DESCRIPTION OF EMBODIMENTS

[Viscosity Index Improver]

The viscosity index improver of the present invention contains a comb-shaped polymer and is prepared so as to satisfy at least the following requirement (I) or (II).

Requirement (I): With respect to a solution having the viscosity index improver dissolved in a mineral oil and having a solid component concentration of 25 mass %, a ratio [(G')/(G")] of a storage modulus (G') to a loss modulus (G") of the solution as measured under conditions of a measuring temperature of 70° C., an angular frequency of 100 rad/s, and a strain of 20% is 0.40 or more.

Requirement (II): With respect to a solution (α) at 25° C. having the viscosity index improver dissolved in a mineral oil and having a solid component concentration of 25 mass % and a solution (β) resulting from subjecting the solution (α) to temperature rise to 100° C. at a temperature rise rate of 0.2° C./s and then cooling to 25° C. at a cooling rate of 0.2° C./s, a ratio [solution (β)/solution (α)] of a storage modulus (G') of the solution (β) as measured under conditions of a measuring temperature of 25° C., an angular frequency of 100 rad/s, and a strain of 1% to a storage modulus (G') of the solution (α) as measured under conditions of a measuring temperature of 25° C., an angular frequency of 100 rad/s, and a strain of 20% is 2.0 or more.

The "storage modulus (G')" and "loss modulus (G")" of the predetermined solution as prescribed in the requirements (I) and (II) mean values measured on a basis of the method described in the Examples.

In addition, the mineral oil that is used for the purpose of preparing the solution as prescribed in the requirements (I) and (II) is not particularly limited, and all of mineral oils classified into Groups 1, 2 and 3 of the base stock categories of the API (American Petroleum Institute) may be used, and mixtures thereof may also be used. More specifically, examples of the mineral oil that is used on the occasion of preparing the solution as prescribed in the requirements (I) and (II) include a 100N mineral oil classified into Group 3 of the base stock categories of the API, which is also used in the Examples as described later.

In the following description of the present specification, the viscosity index improver satisfying the aforementioned requirement (I) is referred to as "viscosity index improver (1)", and the viscosity index improver satisfying the aforementioned requirement (II) is referred to as "viscosity index improver (2)". In addition, the "viscosity index improver of the present invention" refers to both of these "viscosity index improver (1)" and "viscosity index improver (2)".

The viscosity index improver of the present invention is preferably one satisfying both the aforementioned requirements (I) and (II).

The polymethacrylate that is generally used as the viscosity index improver as described in the aforementioned PTL 1 was insufficient in terms of an effect for improving a fuel consumption reducing properties of a lubricating oil composition.

In addition, as the viscosity index improver with which the polymethacrylate is substituted, it is also investigated to use the comb-shaped polymer as described in PTL 2. However, a lubricating oil composition whose fuel consumption reducing properties is thoroughly improved has not been obtained yet.

The present inventor made extensive and intensive investigations. As a result, the present inventor paid attention to the matter that with respect to a viscosity index improver containing a comb-shaped polymer, there is a correlation between a degree of entanglement between molecules in a solution and a change in viscosity attributable to a temperature environment or a change in temperature.

In addition to that, it has been found that by regulating a degree of entanglement between molecules in a solution of a viscosity index improver containing a comb-shaped polymer, a viscosity index improver in which an effect for improving a fuel consumption reducing properties of a lubricating oil composition can be provided.

A general polymethacrylate is small in the degree of entanglement between molecules in a base oil and large in the change in viscosity attributable to a temperature environment or a change in temperature. As a result, it is difficult to thoroughly improve the fuel consumption reducing properties of the lubricating oil composition.

In addition, even in comb-shaped polymers, comb-shaped polymers having various structures are present, and the degree of entanglement between molecules is different in each solution. For that reason, even if a viscosity index improver containing a comb-shaped polymer is used, it is hard to say that the fuel consumption reducing properties of the lubricating oil composition can be always effectively improved.

Namely, the aforementioned requirements (I) and (II) which the viscosity index improver of the present invention satisfies are one prescribing a degree of entanglement between molecules in the solution of a viscosity index improver containing a comb-shaped polymer.

It is meant that as a value of the ratio prescribed in the requirement (I) is larger, the degree of entanglement between molecules of the viscosity index improver in the solution is large at a high temperature. In addition, it is meant that as a value of the ratio prescribed in the requirement (II) is larger, the entanglement at a high temperature is kept even at a low temperature, whereby the entanglement is hardly untied. Accordingly, it may be considered that as the value of the ratio prescribed in each of the requirements (I) and (II) becomes larger, the change in viscosity attributable to a temperature environment or a change in temperature (particularly, a lowering in viscosity in a high-temperature region) is inhibited, whereby the fuel consumption reducing properties of the lubricating oil composition is improved.

Since the viscosity index improver of the present invention is constituted of a resin component containing a comb-shaped polymer satisfying at least one of the foregoing requirements (I) and (II), it is conjectured that in the case where it is blended together with the base oil to provide a lubricating oil composition, the fuel consumption reducing properties can be more improved while making the various properties of the lubricating oil composition favorable.

The viscosity index improver (1) satisfying the requirement (I) and the viscosity index improver (2) satisfying the requirement (II) are hereunder described.

<Viscosity Index Improver (1)>

The viscosity index improver (1) of the present invention is a viscosity index improver containing a comb-shaped polymer and satisfies the following requirement (I).

Requirement (I): With respect to a solution having the viscosity index improver dissolved in a mineral oil and having a solid component concentration of 25 mass %, a ratio [(G')/(G")] of a storage modulus (G') to a loss modulus (G") of the solution as measured under conditions of a measuring temperature of 70° C., an angular frequency of 100 rad/s, and a strain of 20% is 0.40 or more.

The viscosity index improver (1) of the present invention is constituted of a resin containing a comb-shaped polymer having a structure satisfying the aforementioned requirement (I). Namely, it may also be said that the foregoing requirement (I) prescribes indirectly the structure of the viscosity index improver (1) containing a comb-shaped polymer.

The "storage modulus (G')" of the solution as described in the aforementioned requirement (I) is one prescribing elastic properties of the viscosity index improver containing a comb-shaped polymer, and the "loss modulus (G")" is one prescribing viscous properties of the viscosity index improver containing a comb-shaped polymer.

Namely, it is meant that as the value of the aforementioned ratio [(G')/(G")] is larger, with respect to the viscosity index improver containing a comb-shaped polymer in a high-temperature region (70° C.), the elastic properties are relatively larger than the viscous properties. When the elastic properties of the viscosity index improver become large, the degree of entanglement between molecules of the viscosity index improver in the aforementioned solution becomes large even when the solution is made high in temperature.

When the foregoing ratio [(G')/(G")] is less than 0.40, with respect to a viscosity index improver in a high-temperature region (70° C.), the degree of entanglement between molecules in the solution is small. For that reason, such a viscosity index improver causes a lowering in viscosity particularly in a high-temperature region, and even when blended, it is difficult to thoroughly improve the fuel consumption reducing properties of the lubricating oil composition.

From the aforementioned viewpoints, in the viscosity index improver (1) of the present invention, the ratio [(G')/(G")] of a storage modulus (G') to a loss modulus (G") of the solution as described in the requirement (I), which is measured under conditions of a measuring temperature of 70° C., an angular frequency of 100 rad/s, and a strain of 20%, is preferably 0.50 or more, more preferably 0.65 or more, still more preferably 0.80 or more, and yet still more preferably 1.00 or more.

In the viscosity index improver (1) of the present invention, though the ratio [(G')/(G")] of a storage modulus (G') to a loss modulus (G") of the solution as described in the requirement (I) is not particularly limited, from the viewpoint of making fluidity or maintenance of the viscosity in a high-temperature region of the lubricating oil composition favorable, the ratio [(G')/(G")] is typically 100 or less, preferably 50 or less, more preferably 30 or less, and still more preferably 10 or less.

When the ratio [(G')/(G")] of a storage modulus (G') to a loss modulus (G") of the solution as described in the requirement (I) is 100 or less, on the occasion of using the viscosity index improver (1) in the lubricating oil composition, the elastic properties do not become excessively relatively larger than the viscous properties. For that reason, the lubricating oil composition readily flows and is able to maintain the viscosity in a high-temperature region supposing the time of high-speed operation of a high-temperature engine.

From the aforementioned viewpoints, in the viscosity index improver (1) of the present invention, the storage modulus (G') of the solution as described in the requirement (I), which is measured under conditions of a measuring temperature of 70° C., an angular frequency of 100 rad/s, and a strain of 20%, is preferably $1.2\times10^2$ Pa or more, more preferably $1.5\times10^2$ Pa or more, still more preferably $1.7\times10^2$ Pa or more, and yet still more preferably $2.0\times10^2$ Pa or more.

In view of the fact that the storage modulus (G') of the solution as described in the requirement (I) falls within the aforementioned range, the viscosity index improver (1) is readily entangled between molecules in the solution, and the entanglement is appropriately readily untied. For that reason, the viscosity in a high-temperature region supposing the time of high-speed operation of a high-temperature engine can be maintained, and the lubricating oil composition readily flows.

Though an upper limit value of the storage modulus (G') of the solution as described in the requirement (1) is not particularly limited, from the aforementioned viewpoints, it is typically $1.0\times10^5$ Pa or less, and preferably $1.0\times10^4$ Pa or less.

The aforementioned ratio [(G')/(G")] prescribed in the requirement (I) and the storage modulus (G') of the solution as described in the requirement (I) can be, for example, properly regulated taking into consideration the following items.

The comb-shaped polymer constituting the viscosity index improver (1) has a constituent unit (X1) derived from a macromonomer (x1), and as a molecular weight of the macromonomer (x1) is larger, namely a side chain of the comb-shaped polymer is longer, the values of the aforementioned ratio [(G')/(G")] and the aforementioned storage modulus (G') of the solution tend to become larger.

As a content of the constituent unit (X1) derived from the macromonomer (x1) that the aforementioned comb-shaped polymer has is larger, namely the number of side chains of the comb-shaped polymer increases, the values of the aforementioned ratio [(G')/(G")] and the aforementioned storage modulus (G') of the solution tend to become larger.

As a weight average molecular weight (Mw) of the aforementioned comb-shaped polymer is larger, the values of the aforementioned ratio [(G')/(G")] and the aforementioned storage modulus (G') of the solution tend to become larger.

In a main chain of the aforementioned comb-shaped polymer, as a content of a constituent unit derived from an aromatic monomer (for example, a styrene-based monomer, etc.) is smaller, the values of the aforementioned ratio [(G')/(G")] and the aforementioned storage modulus (G') of the solution tend to become larger.

In a main chain of the aforementioned comb-shaped polymer, as a content of a constituent unit derived from a phosphorus atom-containing monomer is smaller, the values of the aforementioned ratio [(G-')/(G")] and the aforementioned storage modulus (G') of the solution tend to become larger.

<Viscosity Index Improver (2)>

The viscosity index improver (2) of the present invention is a viscosity index improver containing a comb-shaped polymer and satisfies the following requirement (II).

Requirement (II): With respect to a solution (α) at 25° C. having the viscosity index improver dissolved in a mineral oil and having a solid component concentration of 25 mass % and a solution (β) resulting from subjecting the solution (α) to temperature rise to 100° C. at a temperature rise rate of 0.2° C./s and then cooling to 25° C. at a cooling rate of 0.2° C./s, a ratio [solution (β)/solution (α)] of a storage modulus (G') of the solution (β) as measured under conditions of a measuring temperature of 25° C., an angular frequency of 100 rad/s, and a strain of 1% to a storage modulus (G') of the solution (α) as measured under conditions of a measuring temperature of 25° C., an angular frequency of 100 rad/s, and a strain of 20% is 2.0 or more.

In the requirement (II), the storage modulus (G') of the solution (β) is a value resulting from measuring the solution (β) obtained through the aforementioned temperature rise and quenching under the aforementioned conditions within the same apparatus used for the preparation of the solution (β) but not a value resulting from, for example, moving the solution (β) after the preparation outside the system and then measuring it.

The viscosity index improver (2) of the present invention is constituted of a resin containing a comb-shaped polymer having a structure satisfying the aforementioned requirement (II). Namely, it may also be said that the requirement (II) prescribes indirectly the structure of the viscosity index improver (2) containing a comb-shaped polymer.

It may be said that as the value of the ratio of the storage modulus (G') of the solution (β) to the solution (α) as prepared by the method prescribed in the requirement (II) and measured under the condition prescribed in the same requirement is larger, the degree of entanglement between molecules of the viscosity index improver in the solution on the occasion of quenching after the temperature rise is larger. This can be explained as follows.

In the preparation process of the solution (β), when the temperature rises to 100° C., the main chain and side chain of the comb-shaped polymer constituting the viscosity index improver are high in mobility of the molecules and spread in the solution, whereby the degree of entanglement between adjacent molecules to each other increases. It is conjectured that when the solution is quenched from 100° C. to 25° C., the mobility of the molecules is lowered while having a spread structure, whereby the degree of entanglement between adjacent molecules to each other is maintained. As the side chain of the comb-shaped polymer becomes longer, the number of side chains of the comb-shaped polymer increases, and the weight average molecular weight (Mw) of the comb-shaped polymer is larger, the entanglement once formed in the solution is hardly untied and maintained even at the time of quenching.

It may also be said that the comb-shaped polymer that is contained in the viscosity index improver having a large value of the ratio of the storage modulus (G') of the solution (β) to the solution (α) has a structure having a large degree of entanglement between molecules in the solution.

It may be considered that the viscosity index improver containing such a comb-shaped polymer is suppressed in a change in viscosity attributable to a change in temperature (particularly a lowering in viscosity in a high-temperature region), is excellent in an effect for improving the fuel consumption reducing properties of the lubricating oil composition, and further, is suppressed in a change in viscosity with a lapse of time. Thus, it may be said that such a viscosity index improver is also excellent in durability of the lubricating oil composition.

It may be considered that on the occasion of quenching after the temperature rise, a viscosity index improver in which the ratio [solution (β)/solution (α)] of the storage modulus (G') of the solution (β) to the solution (α) is less than 2.0 has a structure in which the entanglement between molecules in the solution is liable to be untied. As a result, the foregoing viscosity index improver is liable to bring a change in viscosity attributable to a change in temperature, and an effect for improving the fuel consumption reducing properties of the lubricating oil composition is insufficient.

From the aforementioned viewpoints, in the viscosity index improver (2) of the present invention, the ratio [solution (β)/solution (α)] of the storage modulus (G') of the solution (β) to the solution (α) as prepared by the method prescribed in the requirement (II) and measured under the condition prescribed in the same requirement is preferably 4.0 or more, more preferably 6.0 or more, still more preferably 8.0 or more, and yet still more preferably 10.0 or more.

In the viscosity index improver (2) of the present invention, the ratio [solution (β)/solution (α)] of the storage modulus (G') of the solution (β) to the solution (α) as described in the requirement (II) is typically 1,000,000 or less.

The "ratio of the storage modulus (G') of the solution (β) to the solution (α)" as prepared by the method prescribed in the requirement (II) and measured under the condition prescribed in the same requirement can be, for example, properly regulated taking into consideration the following items.

- The comb-shaped polymer constituting the viscosity index improver (1) has a constituent unit (X1) derived from a macromonomer (x1), and as a molecular weight of the macromonomer (x1) is larger, namely a side chain of the comb-shaped polymer is longer, the values of these ratios tend to become larger.
- As a content of the constituent unit (X1) derived from the macromonomer (x1) that the aforementioned comb-shaped polymer has is larger, namely the number of side chains of the comb-shaped polymer increases, the values of these ratios tend to become larger.
- As a weight average molecular weight (Mw) of the aforementioned comb-shaped polymer is larger, the values of these ratios tend to become larger.
- In a main chain of the aforementioned comb-shaped polymer, as a content of a constituent unit derived from an aromatic monomer (for example, a styrene-based monomer, etc.) is smaller, the values of these ratios tend to become larger.
- In a main chain of the aforementioned comb-shaped polymer, as a content of a constituent unit derived from a phosphorus atom-containing monomer is smaller, the values of these ratios tend to become larger.

In the viscosity index improver (2) of the present invention, from the aforementioned viewpoints, a ratio [solution (β)/solution (α)] of a complex viscosity ($|\eta^*|$) of the solution (β) to the solution (α) as prepared by the method prescribed in the requirement (II) and measured under the conditions prescribed in the same requirement is preferably 1.50 or more, more preferably 2.00 or more, still more preferably 2.30 or more, and yet still more preferably 3.50 or more.

It is known via the empiric Cox-Merz-rule that in the case where a measuring object is a liquid, the complex viscosity ($|\eta^*|$) is equal to a shear viscosity. For that reason, it may also be said that the foregoing ratio is a "viscosity ratio of the solution ($\beta$) to the solution ($\alpha$)".

The "comb-shaped polymer" which the viscosity index improver of the present invention contains is hereunder described.

<Comb-Shaped Polymer>

In the present invention, the "comb-shaped polymer" refers to a polymer having a structure having a large number of trigeminal branch points from which a high-molecular weight side chain comes out in a main chain thereof.

As the comb-shaped polymer having such a structure, a polymer having at least a constituent unit (X1) derived from a macromonomer (x1) is preferred. This constituent unit (X1) is corresponding to the aforementioned "high-molecular weight side chain".

In the present invention, the aforementioned "macromonomer" means a high-molecular weight monomer having a polymerizable functional group and is preferably a high-molecular weight monomer having a polymerizable functional group in an end thereof.

A number average molecular weight (Mn) of the macromonomer (x1) is preferably 200 or more, more preferably 500 or more, still more preferably 600 or more, and yet still more preferably 700 or more, and preferably 200,000 or less, more preferably 100,000 or less, still more preferably 50,000 or less, and yet still more preferably 20,000 or less.

Examples of the polymerizable functional group which the macromonomer (x1) has include an acryloyl group ($CH_2{=}CH{-}COO{-}$), a methacryloyl group ($CH_2{=}CCH_3{-}COO{-}$), an ethenyl group ($CH_2{=}CH{-}$), a vinyl ether group ($CH_2{=}CH{-}O{-}$), an allyl group ($CH_2{=}CH{-}CH_2{-}$), an allyl ether group ($CH_2{=}CH{-}CH_2{-}O{-}$), a group represented by $CH_2{=}CH{-}CONH{-}$, a group represented by $CH_2{=}CCH_3{-}CONH{-}$, and the like.

The macromonomer (x1) may also have at least one selected from repeating units represented by the following general formulae (i) to (iii) in addition to the aforementioned polymerizable functional groups.

(i)

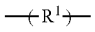

(ii)

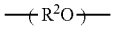

(iii)

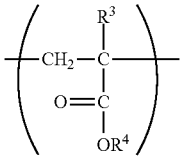

In the general formula (i), $R^1$ represents a linear or branched chain alkylene group having a carbon number of 1 to 10, and specifically, examples thereof include a methylene group, an ethylene group, a 1,2-propylene group, a 1,3-propylene group, a 1,2-butylene group, a 1,3-butylene group, a 1,4-butylene group, a pentylene group, a hexylene group, a heptylene group, an octylene group, a nonylene group, a decylene group, an isopropyl group, an isobutyl group, a 2-ethylhexylene group, and the like.

In the general formula (ii), $R^2$ represents a linear or branched chain alkylene group having a carbon number of 2 to 4, and specifically, examples thereof include an ethylene group, a 1,2-propylene group, a 1,3-propylene group, a 1,2-butylene group, a 1,3-butylene group, a 1,4-butylene group, and the like.

In the general formula (iii), $R^3$ represents a hydrogen atom or a methyl group.

$R^4$ represents a linear or branched chain alkyl group having a carbon number of 1 to 10, and specifically, examples thereof include a methyl group, an ethyl group, a n-propyl group, a n-butyl group, a n-pentyl group, a n-hexyl group, a n-heptyl group, a n-octyl group, a n-nonyl group, a n-decyl group, an isopropyl group, an isobutyl group, a sec-butyl group, a t-butyl group, an isopentyl group, a t-pentyl group, an isohexyl group, a t-hexyl group, an isoheptyl group, a t-heptyl group, a 2-ethylhexyl group, an isooctyl group, an isononyl group, an isodecyl group, and the like.

In the case where the macromonomer (x1) has a plurality of repeating units represented by each of the general formulae (i) to (iii), $R^1$, $R^2$, $R^3$, and $R^4$ may be each the same as or different from each other.

In the case where the macromonomer (x1) is a copolymer having two or more repeating units selected from the general formulae (i) to (iii), the mode of the copolymer may be a block copolymer or may be a random copolymer.

In the embodiment of the present invention, the comb-shaped polymer may be a homopolymer composed of only the constituent unit (X1) derived from one kind of the macromonomer (x1) or may be a copolymer containing the constituent unit (X1) derived from two or more kinds of the macromonomer (x1).

In addition, in the embodiment of the present invention, the comb-shaped polymer may also be a copolymer containing the constituent unit derived from the macromonomer (x1) as well as a constituent unit (X2) derived from other monomer (x2) than the macromonomer (x1).

As a specific structure of such a comb-shaped polymer, a copolymer having a side chain containing the constituent unit (X1) derived from the macromonomer (x1) relative to the main chain containing the constituent unit (X2) derived from the monomer (x2) is preferred.

Examples of the monomer (x2) include a monomer (x2-a) represented by the following general formula (a1), an alkyl (meth)acrylate (x2-b), a nitrogen atom-containing vinyl monomer (x2-c), a hydroxyl group-containing vinyl monomer (x2-d an aliphatic hydrocarbon-based vinyl monomer (x2-e), an alicyclic hydrocarbon-based vinyl monomer (x2-0, a vinyl ester (x2-g), a vinyl ether (x2-h), a vinyl ketone (x2-i), an epoxy group-containing vinyl monomer (x2-j), a halogen element-containing vinyl monomer (x2-k), an ester of unsaturated polycarboxylic acid (x2-l), a (di)alkyl fumarate (x2-m), a (di)alkyl maleate (x2-n), and the like.

In the present specification, for example, the "alkyl (meth) acrylate" is used as a terminology expressing both an "alkyl acrylate" and an "alkyl methacrylate", and other analogous terms or similar expressions are also the same.

(Monomer (x2-a) Represented by the Following General Formula (a1))

(a1)

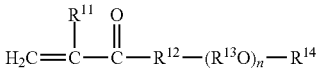

In the general formula (a1), $R^{11}$ represents a hydrogen atom or a methyl group.

$R^{12}$ represents a single bond, a linear or branched chain alkylene group having a carbon number of 1 to 10, —O—, or —NH—.

$R^{13}$ represents a linear or branched chain alkylene group having a carbon number of 2 to 4. In addition, n represents an integer of 1 or more (preferably an integer of 1 to 20, and more preferably an integer of 1 to 5). In the case where n is an integer of 2 or more, plural $R^{13}$s may be the same as or different from each other, and furthermore, the $(R^{13}O)_n$ moiety may be either a random bond or a block bond.

$R^{14}$ represents a linear or branched chain alkyl group having a carbon number of 1 to 60 (preferably 10 to 50, and more preferably 20 to 40).

Specific groups of the above-described "linear or branched chain alkylene group having a carbon number of 1 to 10", "linear or branched chain alkylene group having a carbon number of 2 to 4", and "linear or branched chain alkyl group having a carbon number of 1 to 60" include the same groups as those exemplified in the descriptions regarding the aforementioned general formulae (i) to (iii).

(Alkyl (Meth)Acrylate (x2-b))

Examples of the alkyl (meth)acrylate (x2-b) include methyl (meth)acrylate, ethyl (meth)acrylate, n-propyl (meth)acrylate, isopropyl (meth)acrylate, n-butyl (meth) acrylate, t-butyl (meth)acrylate, pentyl (meth)acrylate, hexyl (meth)acrylate, 2-ethylhexyl (meth)acrylate, heptyl (meth) acrylate, 2-t-butylheptyl (meth)acrylate, octyl (meth)acrylate, 3-isopropylheptyl (meth)acrylate, and the like.

The carbon number of the alkyl group which the alkyl (meth)acrylate (x2-b) has is preferably 1 to 30, more preferably 1 to 26, and still more preferably 1 to 10.

(Nitrogen Atom-Containing Vinyl Monomer (x2-c))

Examples of the nitrogen atom-containing vinyl monomer (x2-c) include an amide group-containing vinyl monomer (x2-c1), a nitro group-containing vinyl monomer (x2-c2), a primary amino group-containing vinyl monomer (x2-c3), a secondary amino group-containing vinyl monomer (x2-c4), a tertiary amino group-containing vinyl monomer (x2-c5), a nitrile group-containing vinyl monomer (x2-c6), and the like.

Examples of the amide group-containing vinyl monomer (x2-c1) include (meth)acrylamide; monoalkylamino (meth) acrylamides, such as N-methyl (meth)acrylamide, N-ethyl (meth)acrylamide, N-isopropyl (meth)acrylamide, N-n- or isobutyl (meth)acrylamide, etc.; monoalkylaminoalkyl (meth)acrylamides, such as N-methylaminoethyl (meth) acrylamide, N-ethylaminoethyl (meth)acrylamide, N-isopropylamino-n-butyl (meth)acrylamide, N-n- or isobutylamino-n-butyl (meth)acrylamide, etc.; dialkylamino (meth) acrylamides, such as N,N-dimethyl (meth)acrylamide, N,N-diethyl (meth)acrylamide, N,N-diisopropyl (meth) acrylamide, N,N-di-n-butyl (meth)acrylamide, etc.; dialkylaminoalkyl (meth)acrylamides, such as N,N-dimethylaminoethyl (meth)acrylamide, N,N-diethylaminoethyl (meth)acrylamide, N,N-dimethylaminopropyl (meth)acrylamide, N,N-di-n-butylaminobutyl (meth)acrylamide, etc.; N-vinylcarboxylic acid amides, such as N-vinylformamide, N-vinylacetamide, N-vinyl-n- or isopropionylamide, N-vinylhydroxyacetamide, etc.; and the like.

Examples of the nitro group-containing monomer (x2-c2) include nitroethylene, 3-nitro-1-propene, and the like.

Examples of the primary amino group-containing vinyl monomer (x2-c3) include alkenylamines having an alkenyl group having a carbon number of 3 to 6, such as (meth) allylamine, crotylamine, etc.; aminoalkyl (meth)acrylates having an alkyl group having a carbon number of 2 to 6, such as aminoethyl (meth)acrylate, etc.; and the like.

Examples of the secondary amino group-containing vinyl monomer (x2-c4) include monoalkylaminoalkyl (meth) acrylates, such as t-butylaminoethyl (meth)acrylate, methylaminoethyl (meth)acrylate, etc.; dialkenylamines having a carbon number of 6 to 12, such as di(meth)allylamine, etc.; and the like.

Examples of the tertiary amino group-containing vinyl monomer (x2-c5) include dialkylaminoalkyl (meth)acrylates, such as dimethylaminoethyl (meth)acrylate, diethylaminoethyl (meth)acrylate, etc.; alicyclic (meth)acrylates having a nitrogen atom, such as morpholinoethyl (meth) acrylate, etc.; aromatic vinyl-based monomers, such as diphenylamine (meth)acrylamide, 4-vinylpyridine, 2-vinylpyridine, N-vinylpyrrole, N-vinylpyrrolidone, N-vinylthiopyrrolidone, etc.; hydrochlorides, sulfates, or lower alkyl (carbon number: 1 to 8) monocarboxylic acid (e.g., acetic acid, propionic acid, etc.) salts thereof, and the like.

Examples of the nitrile group-containing vinyl monomer (x2-c6) include (meth)acrylonitrile and the like.

(Hydroxyl Group-Containing Vinyl Monomer (x2-d))

Examples of the hydroxyl group-containing vinyl monomer (x2-d) include a hydroxyl group-containing vinyl monomer (x2-d1), a polyoxyalkylene chain-containing vinyl monomer (x2-d2), and the like.

Examples of the hydroxyl group-containing vinyl monomer (x2-d1) include hydroxyalkyl (meth)acrylates having an alkyl group having a carbon number of 2 to 6, such as 2-hydroxyethyl (meth)acrylate, 2- or 3-hydroxypropyl (meth)acrylate, etc.; mono- or di-hydroxyalkyl-substituted (meth)acrylamides having an alkyl group having a carbon number of 1 to 4, such as N,N-dihydroxymethyl (meth) acrylamide, N,N-dihydroxypropyl (meth)acrylamide, N,N-di-2-hydroxybutyl (meth)acrylamide, etc.; vinyl alcohol; alkenols having a carbon number of 3 to 12, such as (meth)allyl alcohol, crotyl alcohol, isocrotyl alcohol, 1-octenol, 1-undecenol, etc.; alkene monools or alkene diols each having a carbon number of 4 to 12, such as 1-buten-3-ol, 2-buten-1-ol, 2-butene-1,4-diol, etc.; hydroxyalkyl alkenyl ethers having an alkyl group having a carbon number of 1 to 6 and an alkenyl group having a carbon number of 3 to 10, such as 2-hydroxyethyl propenyl ether, etc.; alkenyl ethers or (meth)acrylates of a polyhydric alcohol, such as glycerin, pentaerythritol, sorbitol, sorbitan, a sugar, sucrose, etc.; and the like.

Examples of the polyoxyalkylene chain-containing vinyl monomer (x2-d2) include a polyoxyalkylene glycol (carbon number of the alkylene group: 2 to 4, degree of polymerization: 2 to 50), a polyoxyalkylene polyol (polyoxyalkylene ether of the aforementioned polyhydric alcohol (carbon number of the alkylene group: 2 to 4, degree of polymerization: 2 to 100)), a mono(meth)acrylate of an alkyl ether (carbon number: 1 to 4) of a polyoxyalkylene glycol or polyoxyalkylene polyol [e.g., polyethylene glycol (Mn: 100 to 300) mono(meth)acrylate, polypropylene glycol (Mn: 130 to 500) mono(meth)acrylate, methoxypolyethylene glycol (Mn: 110 to 310) (meth)acrylate, lauryl alcohol ethylene oxide adduct (2 to 30 mols) (meth)acrylate, mono(meth) acrylic acid polyoxyethylene (Mn: 150 to 230) sorbitan, etc.], and the like.

(Aliphatic Hydrocarbon-Based Vinyl Monomer (x2-e))

Examples of the aliphatic hydrocarbon-based vinyl monomer (x2-e) include alkenes having a carbon number of 2 to 20, such as ethylene, propylene, butene, isobutylene, pentene, heptene, diisobutylene, octene, dodecene, octadecene, etc.; alkadienes having a carbon number of 4 to 12, such as butadiene, isoprene, 1,4-pentadiene, 1,6-heptadiene, 1,7-octadiene, etc.; and the like.

The carbon number of the aliphatic hydrocarbon-based vinyl monomer (x2-e) is preferably 2 to 30, more preferably 2 to 20, and still more preferably 2 to 12.

(Alicyclic Hydrocarbon-Based Vinyl Monomer (x2-f))

Examples of the alicyclic hydrocarbon-based vinyl monomer (x2-f) include cyclohexene, (di)cyclopentadiene, pinene, limonene, vinylcyclohexene, ethylidene bicycloheptene, and the like.

The carbon number of the alicyclic hydrocarbon-based vinyl monomer (x2-f) is preferably 3 to 30, more preferably 3 to 20, and still more preferably 3 to 12.

(Vinyl Ester (x2-g))

Examples of the vinyl ester (x2-g) include vinyl esters of a saturated fatty acid having a carbon number of 2 to 12, such as vinyl acetate, vinyl propionate, vinyl butyrate, vinyl octanoate, etc.; and the like.

(Vinyl Ether (x2-h))

Examples of the vinyl ether (x2-h) include alkyl vinyl ethers having a carbon number of 1 to 12, such as methyl vinyl ether, ethyl vinyl ether, propyl vinyl ether, butyl vinyl ether, 2-ethylhexyl vinyl ether, etc.; alkoxyalkyl vinyl ethers having a carbon number of 1 to 12, such as vinyl-2-methoxyethyl ether, vinyl-2-butoxyethyl ether, etc.; and the like.

(Vinyl Ketone (x2-i))

Examples of the vinyl ketone (x2-i) include alkyl vinyl ketones having a carbon number of 1 to 8, such as methyl vinyl ketone, ethyl vinyl ketone, etc.; and the like.

(Epoxy Group-Containing Vinyl Monomer (x2-j))

Examples of the epoxy group-containing vinyl monomer (x2-j) include glycidyl (meth)acrylate, glycidyl (meth)allyl ether, and the like.

(Halogen Element-Containing Vinyl Monomer (x2-k))

Examples of the halogen element-containing vinyl monomer (x2-k) include vinyl chloride, vinyl bromide, vinylidene chloride, (meth)allyl chloride, and the like.

(Ester of Unsaturated Polycarboxylic Acid (x2-l))

Examples of the ester of unsaturated polycarboxylic acid (x2-l) include an alkyl ester of an unsaturated polycarboxylic acid, a cycloalkyl ester of an unsaturated polycarboxylic acid, an aralkyl ester of an unsaturated polycarboxylic acid, and the like; and examples of the unsaturated carboxylic acid include maleic acid, fumaric acid, itaconic acid, and the like.

((Di)Alkyl Fumarate (x2-m))

Examples of the (di)alkyl fumarate (x2-m) include monomethyl fumarate, dimethyl fumarate, monoethyl fumarate, diethyl fumarate, methylethyl fumarate, monobutyl fumarate, dibutyl fumarate, dipentyl fumarate, dihexyl fumarate, and the like.

((Di)Alkyl Maleate (x2-n))

Examples of the (di)alkyl maleate (x2-n) include monomethyl maleate, dimethyl maleate, monoethyl maleate, diethyl maleate, methylethyl maleate, monobutyl maleate, dibutyl maleate, and the like.

In the viscosity index improver according to the embodiment of the present invention, from the viewpoint of providing a viscosity index improver satisfying the aforementioned requirements (I) and (II), a content of the constituent unit derived from an aromatic monomer is preferably less than 10 mass %, more preferably less than 5 mass %, still more preferably less than 3 mass %, yet still more preferably less than 1 mass %, and especially preferably less than 0.1 mass % relative to the whole of constituent units (100 mass %) of the comb-shaped polymer.

In addition, in the viscosity index improver according to the embodiment of the present invention, from the viewpoint of providing a viscosity index improver satisfying the aforementioned requirements (I) and (II), a content of the constituent unit derived from a styrene-based monomer is preferably less than 10 mass %, more preferably less than 5 mass %, still more preferably less than 3 mass %, yet still more preferably less than 1 mass %, and especially preferably less than 0.1 mass % relative to the whole of constituent units (100 mass %) of the comb-shaped polymer.

In addition, in the viscosity index improver according to the embodiment of the present invention, from the viewpoint of providing a viscosity index improver satisfying the aforementioned requirements (I) and (II), a content of the constituent unit derived from a phosphorus atom-containing monomer is preferably less than 10 mass %, more preferably less than 5 mass %, still more preferably less than 3 mass %, yet still more preferably less than 1 mass %, and especially preferably less than 0.1 mass % relative to the whole of constituent units (100 mass %) of the comb-shaped polymer.

Examples of the aforementioned "phosphorus atom-containing monomer" include a phosphate ester group-containing monomer, a phosphono group-containing monomer, and the like.

In the embodiment of the present invention, from the viewpoint of improving the fuel consumption reducing properties, a weight average molecular weight (Mw) of the comb-shaped polymer is preferably 10,000 to 1,000,000, more preferably 30,000 to 850,000, still more preferably 60,000 to 700,000, and yet still more preferably 100,000 to 650,000.

In addition, from the viewpoint of providing a viscosity index improver satisfying the requirements (I) and (II), a weight average molecular weight (Mw) of the comb-shaped polymer is preferably 150,000 to 750,000, more preferably 150,000 to 600,000, still more preferably 200,000 to 500,000, and especially preferably 260,000 to 500,000.

In the embodiment of the present invention, from the viewpoints of providing a viscosity index improver satisfying the requirements (I) and (II) and improving the fuel consumption reducing properties of the lubricating oil composition, a molecular weight distribution (Mw/Mn) of the comb-shaped polymer (wherein Mw represents a weight average molecular weight of the comb-shaped polymer, and Mn represents a number average molecular weight of the comb-shaped polymer) is preferably 8.00 or less, more preferably 7.00 or less, still more preferably 6.50 or less, yet still more preferably 6.00 or less, even yet still more preferably 5.50 or less, even still more further preferably 5.00 or less, and even yet still more further preferably 3.00 or less. As the molecular weight distribution of the comb-shaped polymer becomes smaller, the fuel consumption reducing properties of the lubricating oil composition in which the comb-shaped polymer is contained together with the base oil tends to be more improved.

Though a lower limit value of the molecular weight distribution of the comb-shaped polymer is not particularly limited, it is typically 1.01 or more, preferably 1.05 or more, and more preferably 1.10 or more in terms of a molecular weight distribution (Mw/Mn) of the comb-shaped polymer.

<Component Other than Comb-Shaped Polymer to be Contained in Viscosity Index Improver>

The viscosity index improver of the present invention may contain the unreacted raw materials and catalyst used at the time of synthesis of the comb-shaped polymer as well as a by-product, such as a resin component as formed at the time of synthesis, which is not corresponding to the comb-shaped polymer, etc., so long as the effects of the present invention are not impaired The "solid component concentration" as described in the aforementioned requirements (I) and (II) includes not only the comb-shaped polymer but also the aforementioned unreacted raw materials, catalyst, and by-product, such as a resin component which is not corresponding to the comb-shaped polymer, etc.

In the viscosity index improver of the present invention, a content of the comb-shaped polymer is preferably 90 to 100 mass %, more preferably 95 to 100 mass %, still more preferably 99 to 100 mass %, and yet still more preferably 99.9 to 100 mass % relative to the total amount (100 mass %) of the solid component in the viscosity index improver.

The viscosity index improver of the present invention contains the comb-shaped polymer as a resin component. However, in general, taking into consideration handling properties and solubility in the base oil, in many cases, viscosity index improvers are put on the market in a state of a solution in which the solid component containing a resin, such as the comb-shaped polymer, etc., is dissolved with a diluent oil, such as a mineral oil, a synthetic oil, etc.

In the case where the viscosity index improver of the present invention is in a form of a solution, a solid component concentration of the solution is typically 5 to 30 mass % on a basis of the total amount (100 mass %) of the solution.

[Lubricating Oil Composition]

The lubricating oil composition of the present invention contains the aforementioned viscosity index improver of the present invention together with the base oil.

In addition, in the embodiment of the present invention, the lubricating oil composition may further contain additives for lubricating oil, which are used for general lubricating oils, and so on so long as the effects of the present invention are not impaired.

In the lubricating oil composition according to the embodiment of the present invention, from the viewpoint of providing a lubricating oil composition having an excellent fuel consumption reducing properties, a content of the solid component of the aforementioned viscosity index improver of the present invention is preferably 0.01 to 15.0 mass %, more preferably 0.05 to 10.0 mass %, still more preferably 0.10 to 7.50 mass %, yet still more preferably 0.50 to 5.00 mass %, and even yet still more preferably 0.90 to 4.00 mass % on a basis of the total amount (100 mass %) of the lubricating oil composition.

<Base Oil>

The base oil that is contained in the lubricating oil composition according to the embodiment of the present invention may be either a mineral oil or a synthetic oil, and a mixed oil of a mineral oil and a synthetic oil may also be used.

Examples of the mineral oil include atmospheric residues obtained by subjecting a crude oil, such as a paraffin-based mineral oil, an intermediate base mineral oil, a naphthenic mineral oil, etc., to atmospheric distillation; distillates obtained by subjecting such an atmospheric residue to distillation under reduced pressure; mineral oils and waxes resulting from subjecting the distillate to one or more treatments of solvent deasphalting, solvent extraction, hydro-cracking, solvent dewaxing, catalytic dewaxing, hydrorefining, and the like; mineral oils obtained by isomerizing a wax (GTL wax) produced by a Fischer-Tropsch process or the like; and the like.

Of those, a mineral oil and a wax having been subjected to one or more treatments of solvent deasphalting, solvent extraction, hydro-cracking, solvent dewaxing, catalytic dewaxing, hydrorefining, and the like are preferred; a mineral oil classified into Group 2 or Group 3 of the base stock categories of the API is more preferred; and a mineral oil classified into the foregoing Group 3 is still more preferred.

Examples of the synthetic oil include poly-α-olefins, such as polybutene and an α-olefin homopolymer or copolymer (for example, a homopolymer or copolymer of an α-olefin having a carbon number of 8 to 14, such as an ethylene-α-olefin copolymer, etc.), etc.; various esters, such as a polyol ester, a dibasic acid ester, a phosphate ester, etc.; various ethers, such as a polyphenyl ether, etc.; a polyglycol; an alkylbenzene; an alkylnaphthalene; synthetic oils obtained by isomerizing a wax (GTL wax) produced by a Fischer-Tropsch process or the like; and the like.

Of those synthetic oils, poly-α-olefins are preferred.

In the embodiment of the present invention, from the viewpoint of oxidation stability, at least one selected from a mineral oil classified into Group 2 or Group 3 of the base stock categories of the API (American Petroleum Institute) and a synthetic oil is preferred, and at least one selected from a mineral oil classified into the foregoing Group 3 and a poly-α-olefin is more preferred.

In the embodiment of the present invention, these base oils may be used alone or in combination of any two or more thereof.

In the embodiment of the present invention, a kinematic viscosity at 100° C. of the base oil is preferably 2.0 to 20.0 $mm^2/s$, more preferably 2.0 to 15.0 $mm^2/s$, still more preferably 2.0 to 10.0 $mm^2/s$, and yet still more preferably 2.0 to 7.0 $mm^2/s$.

When the kinematic viscosity at 100° C. of the base oil is 2.0 $mm^2/s$ or more, an evaporation loss is small, and hence, such is preferred. On the other hand, when the kinematic viscosity at 100° C. of the base oil is 20.0 $mm^2/s$ or less, a power loss attributable to viscous resistance is not so large, so that a fuel consumption improving effect is obtained, and hence, such is preferred.

In the embodiment of the present invention, from the viewpoint of providing a lubricating oil composition in which not only the change in viscosity attributable to a change in temperature is suppressed, but also the fuel consumption reducing properties are improved, a viscosity index of the base oil is preferably 80 or more, more preferably 90 or more, and still more preferably 100 or more.

In the embodiment of the present invention, in the case of using a mixed oil composed of a combination of two or more base oils, it is preferred that the kinematic viscosity and the viscosity index of the mixed oil fall within the aforementioned ranges.

In the lubricating oil composition according to the embodiment of the present invention, a content of the base oil is preferably 55 mass % or more, more preferably 60 mass % or more, still more preferably 65 mass % or more, and yet still more preferably 70 mass % or more, and preferably 99 mass % or less, and more preferably 95 mass % or less relative to the total amount (100 mass %) of the lubricating oil composition.

<Additive for Lubricating Oil>

The lubricating oil composition according to the embodiment of the present invention may further contain an additive for lubricating oil other than the viscosity index improver, if desired so long as the effects of the present invention are not impaired.

Examples of the foregoing additive for lubricating oil include a pour-point depressant, a metal-based detergent, a dispersant, an anti-wear agent, an extreme pressure agent, an antioxidant, an anti-foaming agent, a friction modifier, a rust inhibitor, a metal deactivator, and the like.

Among those, it is preferred that the lubricating oil composition according to the embodiment of the present invention contains at least one additive for lubricating oil selected from a pour-point depressant, a metal-based detergent, a dispersant, an anti-wear agent, an extreme pressure agent, an antioxidant, and an anti-foaming agent.

As the additive for lubricating oil, a commercially available additive package that is a mixture containing plural additives in conformity with the API/ILSAC SN/GF-5 standards or the like may also be used.

A compound having plural functions as the additive (for example, a compound having functions as an anti-wear agent and an extreme pressure agent) may also be used.

Though a content of each of these additives for lubricating oil can be properly regulated within the range where the effects of the present invention are not impaired, it is typically 0.001 to 15 mass %, preferably 0.005 to 10 mass %, and more preferably 0.01 to 8 mass % on a basis of the total amount (100 mass %) of the lubricating oil composition.

In the lubricating oil composition according to the embodiment of the present invention, a total content of these additives for lubricating oil is preferably 30 mass % or less, more preferably 25 mass % or less, still more preferably 20 mass % or less, and yet still more preferably 15 mass % or less on a basis of the total amount (100 mass %) of the lubricating oil composition.

(Pour-Point Depressant)

Examples of the pour-point depressant include an ethylene-vinyl acetate copolymer, a condensate of a chlorinated paraffin and naphthalene, a condensate of a chlorinated paraffin and phenol, a polymethacrylate, a polyalkylstyrene, and the like.

In the embodiment of the present invention, these pour-point depressants may be used alone or in combination of any two or more thereof.

(Metal-Based Detergent)

Examples of the metal-based detergent include organic metal salt compounds containing a metal atom selected from an alkali metal atom and an alkaline earth metal atom, and specifically, examples thereof include a metal salicylate, a metal phenate, a metal sulfonate, and the like.

In the embodiment of the present invention, these metal-based detergents may be used alone or in combination of any two or more thereof.

In the present specification, the "alkali metal atom" refers to a lithium atom, a sodium atom, a potassium atom, a rubidium atom, a cesium atom, or a francium atom.

The "alkaline earth metal atom" refers to a beryllium atom, a magnesium atom, a calcium atom, a strontium atom, or a barium atom.

From the viewpoint of improving the detergency at a high temperature, the metal atom that is contained in the metal-based detergent is preferably a sodium atom, a calcium atom, a magnesium atom, or a barium atom, and more preferably a calcium atom.

The metal salicylate is preferably a compound represented by the following general formula (1); the metal phenate is preferably a compound represented by the following general formula (2); and the metal sulfonate is preferably a compound represented by the following general formula (3).

(1)

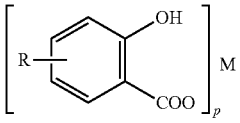

-continued (2)

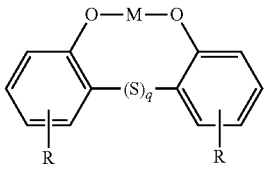

(3)

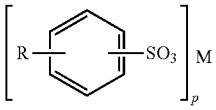

In the general formulae (1) to (3), M is a metal atom selected from an alkali metal atom and an alkaline earth metal atom, and preferably a sodium atom, a calcium atom, a magnesium atom, or a barium atom, with a calcium atom being more preferred. p is a valence of M, and 1 or 2. R is a hydrogen atom or a hydrocarbon group having a carbon number of 1 to 18. q is an integer of 0 or more, and preferably an integer of 0 to 3.

Examples of the hydrocarbon group that may be selected as R include an alkyl group having a carbon number of 1 to 18, an alkenyl group having a carbon number of 1 to 18, a cycloalkyl group having a ring-forming carbon number of 3 to 18, an aryl group having a ring-forming carbon number of 6 to 18, an alkylaryl group having a carbon number of 7 to 18, an arylalkyl group having a carbon number of 7 to 18, and the like.

In the embodiment of the present invention, these metal-based detergents may be used alone or in combination of any two or more thereof.

Among those, from the viewpoint of improving the detergency at a high temperature and the viewpoint of solubility in the base oil, the metal-based detergent is preferably at least one selected from calcium salicylate, calcium phenate, and calcium sulfonate.

In the embodiment of the present invention, the metal-based detergent may be any of a neutral salt, a basic salt, an overbased salt, and a mixture thereof.

In the embodiment of the present invention, in the case where the metal-based detergent is a basic salt or an overbased salt, a base number of the metal-based detergent is preferably 10 to 600 mgKOH/g, and more preferably 20 to 500 mgKOH/g.

In the present specification, the "base number" means a base number as measured by the perchloric acid method in conformity with JIS K2501, Section 7:

"Petroleum products and lubricating oils-neutralization number test method".

(Dispersant)

Examples of the dispersant include a succinimide, benzylamine, a succinic ester, a boron-modified product thereof, and the like.

Examples of the succinimide include monoimides or bisimides of a succinic acid having a polyalkenyl group, such as a polybutenyl group, etc., and having a molecular weight of 300 to 4,000 and a polyethylenepolyamine, such as ethylenediamine, diethylenetriamine, triethylenetetr amine, tetraethylenepentamine, pentaethylenehexamine, etc., or a boronic acid-modified product thereof; Mannich reaction products of phenol, formaldehyde, and a polyethylenepolyamine, having a polyalkenyl group; and the like.

In the embodiment of the present invention, these dispersants may be used alone or in combination of any two or more thereof.

(Anti-Wear Agent)

Examples of the anti-wear agent include sulfur-containing compounds, such as zinc dialkyklithiophosphate (ZnDTP), zinc phosphate, zinc dithiocarbamate, molybdenum dithiocarbamate, molybdenum dithiophosphate, disulfides, sulfurized olefins, sulfurized oils and fats, sulfurized esters, thiocarbonates, thiocarbamates, polysulfides, etc.; phosphorus-containing compounds, such as phosphite esters, phosphate esters, phosphonate esters, and amine salts or metal salts thereof, etc.; and sulfur- and phosphorus-containing anti-wear agents, such as thiophosphite esters, thiophosphate esters, thiophosphonate esters, and amine salts or metal salts thereof, etc.

In the embodiment of the present invention, these anti-wear agents may be used alone or in combination of any two or more thereof.

Of those, zinc dialkyldithiophosphate (ZnDTP) is preferred.

(Extreme Pressure Agent)

Examples of the extreme pressure agent include sulfur-based extreme pressure agents, such as sulfides, sulfoxides, sulfones, thiophosphinates, etc.; halogen-based extreme pressure agents, such as a chlorinated hydrocarbon, etc.; organic metal-based extreme pressure agents; and the like. Among the aforementioned anti-wear agents, compounds having a function as an extreme pressure agent can also be used.

These extreme pressure agents may be used alone or in combination of any two or more thereof.

(Antioxidant)

As the antioxidant, an arbitrary material can be properly selected and used among known antioxidants that have hitherto been used as an antioxidant for a lubricating oil, and examples thereof include an amine-based antioxidant, a phenol-based antioxidant, a molybdenum-based antioxidant, a sulfur-based antioxidant, a phosphorus-based antioxidant, and the like.

Examples of the amine-based antioxidant include diphenylamine-based antioxidants, such as diphenylamine, an alkylated diphenylamine having an alkyl group having a carbon number of 3 to 20, etc.; naphthylamine-based antioxidants, such as α-naphthylamine, a $C_3$-$C_{20}$-alkyl-substituted phenyl-α-naphthylamine, etc.; and the like.

Examples of the phenol-based antioxidant include monophenol-based antioxidants, such as 2,6-di-tert-butyl-4-methylphenol, 2,6-di-tert-butyl-4-ethylphenol, octadecyl-3-(3,5-di-tert-butyl-4-hydroxyphenynpropionate, etc.; diphenol-based antioxidants, such as 4,4'-methylenebis(2,6-di-tert-butylphenol), 2,2'-methylenebis(4-ethyl-6-tert-butylphenol), etc.; hindered phenol-based antioxidants; and the like.

Examples of the molybdenum-based antioxidant include a molybdenum amine complex resulting from a reaction of molybdenum trioxide and/or molybdic acid and an amine compound; and the like.

Examples of the sulfur-based antioxidant include dilauryl-3,3'-thiodipropionate and the like.

Examples of the phosphorus-based antioxidant include a phosphite and the like.

In the embodiment of the present invention, though these antioxidants may be used alone or in combination of any two or more thereof, the use of a combination of any two or more thereof is preferred.

(Anti-Foaming Agent)

Examples of the anti-foaming agent include silicone oil, fluorosilicone oil, a fluoroalkyl ether, and the like.

In the embodiment of the present invention, these anti-foaming agents may be used alone or in combination of any two or more thereof.

(Friction Modifier)

Examples of the friction modifier include molybdenum-based friction modifiers, such as molybdenum dithiocarbamate (MoDTC), molybdenum dithiophosphate (MoDTP), an amine salt of molybdic acid, etc.; ashless friction modifiers having at least one alkyl group or alkenyl group having a carbon number of 6 to 30, such as an aliphatic amine, a fatty acid ester, a fatty acid amide, a fatty acid, an aliphatic alcohol, an aliphatic ether, etc.; and the like.

In the embodiment of the present invention, these friction modifiers may be used alone or in combination of any two or more thereof.

(Rust Inhibitor)

Examples of the rust inhibitor include a petroleum sulfonate, an alkylbenzene sulfonate, dinonylnaphthalene sulfonate, an alkenylsuccinic ester, a polyhydric alcohol ester, and the like.

In the embodiment of the present invention, these rust inhibitors may be used alone or in combination of any two or more thereof.

(Metal Deactivator)

Examples of the metal deactivator include a benzotriazole-based compound, a tolyltriazole-based compound, a thiadiazole-based compound, an imidazole-based compound, a pyrimidine-based compound, and the like.

In the embodiment of the present invention, these metal deactivators may be used alone or in combination of any two or more thereof.

(Other Viscosity Index Improver not Corresponding to Comb-Shaped Polymer)

In the embodiment of the present invention, other viscosity index improver not corresponding to the comb-shaped polymer may be contained in the lubricating oil composition within the range where the effects of the present invention are not impaired.

Examples of the other viscosity index improver include polymers not corresponding to the comb-shaped polymer, such as a polymethacrylate, a dispersion type polymethacrylate, an olefin-based copolymer (for example, an ethylene-propylene copolymer, etc.), a dispersion type olefin-based copolymer, a styrene-based copolymer (for example, a styrene-diene copolymer, a styrene-isoprene copolymer, etc.), etc.

In the embodiment of the present invention, a content of the other viscosity index improver not corresponding to the comb-shaped polymer in the lubricating oil composition is preferably 0 to 20 parts by mass, more preferably 0 to 10 parts by mass, still more preferably 0 to 5 parts by mass, and yet still more preferably 0 to 1 part by mass relative to the total amount (100 parts by mass) of the comb-shaped polymer in the lubricating oil composition.

<Various Physical Properties of Lubricating Oil Composition>

In the embodiment of the present invention, from the viewpoint of providing a lubricating oil composition having favorable lubricating performance, viscosity properties, and fuel consumption reducing properties, a kinematic viscosity at 100° C. of the lubricating oil composition is preferably 3.0 to 12.5 $mm^2/s$, more preferably 4.0 to 11.0 $mm^2/s$, still more preferably 5.0 to 10.0 $mm^2/s$, and yet still more preferably 6.0 to 9.0 $mm^2/s$.

In the embodiment of the present invention, from the viewpoint of providing a lubricating oil composition in which a change in viscosity attributable to a change in temperature is suppressed, and the fuel consumption reducing properties are improved, a viscosity index of the lubricating oil composition is preferably 120 or more, more preferably 150 or more, still more preferably 170 or more, and yet still more preferably 200 or more.

The aforementioned values of the kinematic viscosities at 40° C. and 100° C. and the viscosity index of the lubricating oil composition mean values as measured in conformity with JIS K2283:2000.

In the embodiment of the present invention, from the viewpoint of providing a lubricating oil composition having favorable low-temperature viscosity properties, a CCS viscosity (low-temperature viscosity) at −35° C. of the lubricating oil composition is preferably 7,000 mPa·s or less, more preferably 6,000 mPa·s or less, still more preferably 5,000 mPa·s or less, and yet still more preferably 4,000 mPa·s or less.

The aforementioned CCS viscosity (low-temperature viscosity) at −35° C. of the lubricating oil composition means a value as measured in conformity with JIS K2010:1993 (ASTM D2602).

In the embodiment of the present invention, an HTHS viscosity (high temperature high shear viscosity) at 150° C. of the lubricating oil composition is preferably 1.4 to 3.5 mPa·s, more preferably 1.6 to 3.2 mPa·s, still more preferably 1.8 to 3.0 mPa·s, and yet still more preferably 2.0 to 2.8 mPa·s.

When the HTHS viscosity at 150° C. is 1.4 mPa·s or more, a lubricating oil composition having a favorable lubricating performance may be provided. On the other hand, when the HTHS viscosity at 150° C. is 3.5 mPa·s or less, a lubricating oil composition in which a lowering of the viscosity properties at a low temperature is suppressed, and the fuel consumption reducing properties is favorable can be provided.

The aforementioned HTHS viscosity at 150° C. can also be supposed as a viscosity in a high-temperature region at the time of high-speed operation of an engine. Namely, so long as the HTHS viscosity at 150° C. of the lubricating oil composition falls within the aforementioned range, it may be said that the lubricating oil composition is favorable in various properties, such as a viscosity in a high-temperature region supposing the time of high-speed operation of an engine, etc.

The aforementioned HTHS viscosity at 150° C. of the lubricating oil composition is a value as measured in conformity with ASTM D4741, and in more detail, it means a value as measured by the method described in the Examples.

In the embodiment of the present invention, a density at 15° C. of the lubricating oil composition is preferably 0.80 to 0.90 g/cm$^3$, and more preferably 0.82 to 0.87 g/cm$^3$.

The aforementioned density at 15° C. of the lubricating oil composition means a value as measured in conformity with JIS K2249:2011.

<Application of Lubricating Oil Composition>

The lubricating oil composition of the present invention is excellent in fuel consumption reducing properties while making various properties, such as a viscosity in a high-temperature region supposing the time of high-speed operation of an engine, etc., favorable.

For that reason, examples of the engine filled with the lubricating oil composition of the present invention include engines for vehicles, such as an automobile, an electric train, an aircraft, etc., and an engine for automobile is suitable.

Though the lubricating oil composition according to the embodiment of the present invention is suitably applied as a lubricating oil composition for internal combustion engine (engine oil for internal combustion engine) to be used for vehicles, such as an automobile, an electric train, an aircraft, etc., it may also be adopted for other applications.

Examples of other applications which may be considered with respect to the lubricating oil composition according to the embodiment of the present invention include a power stirring oil, an automatic transmission fluid (ATF), a continuously variable transmission fluid (CVTF), a hydraulic fluid, a turbine oil, a compressor oil, a lubricating oil for machine tool, a cutting oil, a gear oil, a fluid bearing oil, a rolling bearing oil, and the like.

[Method for Producing Lubricating Oil Composition]

The present invention also provides a method for producing a lubricating oil composition including the following step (A).

Step (A): A step of blending a base oil with the aforementioned viscosity index improver of the present invention.

In the step (A), the used base oil and the aforementioned viscosity index improver of the present invention are those as described above, and the suitable components and contents of the respective components are also the same.

In addition, in the present step, other additives for lubricating oil than the base oil and the aforementioned viscosity index improver to be blended in the lubricating oil composition of the present invention may also be blended. Details of the foregoing additives for lubricating oil are also the same as described above.

It is preferred that after blending the respective components, the resulting blend is stirred and uniformly dispersed by a known method.

From the viewpoint of uniformly dispersing the blend, it is more preferred that after subjecting the base oil to temperature rise to 40 to 70° C., the viscosity index improver of the present invention and the additives for lubricating oil are blended and stirred, thereby uniformly dispersing the blend.

Lubricating oil compositions obtained in the case where after blending the respective components, a part of the components denatures, or two of the components react with each other to form another component, are also corresponding to the lubricating oil composition obtained by the method for producing the lubricating oil composition of the present invention and fall within the technical scope of the present invention.

EXAMPLES

The present invention is hereunder described in more detail by reference to Examples, but it should be construed that the present invention is by no means limited by these Examples. Measuring methods and evaluation method of various physical properties of the viscosity index improver, base oil, and lubricating oil composition are as follows.

<Measuring Method of Physical Properties of Viscosity Index Improver>

(1) Weight average molecular weight (Mw) and number average molecular weight (Mn):

Using a gel permeation chromatograph apparatus ("1260 Model HPLC", manufactured by Agilent), the measurement was performed under the following conditions, and a value as converted into standard polystyrene was adopted.

(Measuring Conditions)

Column: One in which two of "Shodex LF404" are successively connected to each other Column temperature: 35° C.

Developing solvent: Chloroform

Flow rate: 0.3 mL/min

<Measuring Method of Various Physical Properties of Base Oil or Lubricating Oil Composition>

(2) Kinematic viscosities at 40° C. and 100° C.:

The measurement was performed in conformity with JIS K2283:2000.

(3) Viscosity index:

The measurement was performed in conformity with JIS K2283:2000.

(4) CCS viscosity (Low-Temperature Viscosity) at −35° C.:

The measurement was performed in conformity with JIS K2010:1993 (ASTM D2602).

(5) HTHS Viscosity (High Temperature High Shear Viscosity) at 150° C.:

A viscosity after shearing a lubricating oil composition as a measuring object at 150° C. and at a shear rate of $10^6$/s was measured in conformity with ASTM D4741.

(6) Density at 15° C.:

The measurement was performed in conformity with JIS K2249:2011.

<Evaluation Method of Fuel Consumption Reducing Properties of Lubricating Oil Composition>

(7) Driving torque improving rate:

A main shaft of an SOHC (single overhead camshaft) engine having a displacement of 1.5 L was driven by a motor, and on that occasion, a torque applied to the main shaft was measured. The number of revolutions of the main shaft was 1,500 rpm, and an engine oil temperature and a water temperature were set to 80° C., respectively.

A driving torque improving rate (%) of each of Examples 3 to 4 and Comparative Examples 5 to 6 was calculated according to the following equation on a basis of a measured value of a torque when using a lubricating oil composition of Comparative Example 4.

[Driving torque improving rate] (%)={([Measured value of torque when using lubricating oil composition of Comparative Example 4]−[Measured value of torque when using objective lubricating oil composition])/[Measured value of torque when using lubricating oil composition of Comparative Example 4]}×100

In comparison with the time when using the lubricating oil composition of Comparative Example 4, in the case where the measured value of the torque is small, the value of the driving torque improving rate as calculated according to the aforementioned equation becomes plus.

As the value of the driving torque improving rate as calculated according to the aforementioned equation is larger, the driving torque is improved, so that it may be said that the fuel consumption reducing properties of the lubricating oil composition as a measuring object is high. In the present specification, the case where the value of the driving torque improving rate is "0.2% or more" is designated as acceptance, and the resulting lubricating oil composition is judged to be high in fuel consumption reducing properties.

Examples 1 to 2 and Comparative Examples 1 to 3

(1) Preparation of Solutions (A) to (E) Having a Solid Component Concentration of 25 Mass %

Using an ultrasonic cleaning system equipped with a temperature rise function, after heating a 100N mineral oil to be used as a diluent oil to 55° C., a viscosity index improver of each kind shown in Table 1 was added in a blending amount such that a solid component concentration was 25 mass %, and an ultrasonic wave was applied over at least one hour, thereby uniformly dispersing the added viscosity index improver in the 100N mineral oil corresponding to a mineral oil prescribed in the aforementioned requirements (I) and (II). Thereafter, the dispersion was cooled from 55° C. to 25° C. at a temperature drop rate of 0.02° C./s. There were thus prepared Solutions (A) to (E) each having a solid component concentration of 25 mass %.

In the present Examples and Comparative Examples, details of the "100N mineral oil" corresponding to a mineral oil prescribed in the aforementioned requirements (I) and (II) and "Viscosity Index Improvers (A-1) to (E-1)" used as the viscosity index improver are as follows.

<Mineral Oil Prescribed in the Requirements (I) and (II)>

100N mineral oil: A mineral oil having a kinematic viscosity at 40° C. of 17.8 $mm^2$/s, a kinematic viscosity at 100° C. of 4.07 $mm^2$/s, a viscosity index of 131, and a density at 15° C. of 0.824 g/$cm^3$, the base oil being classified into Group 3 of the base stock categories of the API.

<Viscosity Index Improver>

Viscosity Index Improver (A-1): A comb-shaped polymer having at least a constituent unit derived from a macromonomer having an Mn of 500 or more (Mw=480,000, Mw/Mn=2.4).

Viscosity Index Improver (B-1): A comb-shaped polymer having at least a constituent unit derived from a macromonomer having an Mn of 500 or more (Mw=420,000, Mw/Mn=5.2).

Viscosity Index Improver (C-1): A comb-shaped polymer having at least a constituent unit derived from a macromonomer having an Mn of 500 or more and a constituent unit derived from a styrene-based monomer (Mw=250,000, Mw/Mn=2.1).

Viscosity Index Improver (D-1): A polymethacrylate (Mw=230,000, Mw/Mn=2.1).

Viscosity Index Improver (E-1): A polymethacrylate (Mw=200,000, Mw/Mn=2.3).

(2) Measurement 1: Measurement of Storage Modulus (G') and Loss Modulus (G") of each of Solutions (A) to (E) at a Measuring Temperature of 70° C.

Using a rheometer "Physica MCR 301", manufactured by Anton Paar, the measurement was performed by the following procedures.

First of all, any one of the Solutions (A) to (E) as prepared by the foregoing (1) was inserted into a cone plate (diameter: 50 mm, angle of inclination: 1°) as temperature-controlled at 70° C. and held at 70° C. for 10 minutes, thereby preparing a solution described in the aforementioned requirement (I). On that occasion, attention was paid such that a strain was not given to the inserted solution.

Thereafter, a storage modulus (G') and a loss modulus (G") of each of the solutions were measured in a vibration mode under conditions of a measuring temperature of 70° C., an angular frequency of 100 rad/s, and a strain of 20%, and a ratio of G'/G" was calculated at the same time. These results are shown in Table 1.

(3) Measurement 2: Measurement of Storage Modulus (G') and Complex Viscosity (|η*|) of Each of Solutions (A) to (E) Prepared so as to Correspond to the Aforementioned "Solution (α)" at a Measuring Temperature of 25° C.

Using a rheometer "Physica MCR 301", manufactured by Anton Paar, the measurement was performed by the following procedures.

First of all, any one of the Solutions (A) to (E) as prepared by the foregoing (1) was inserted into a cone plate (diameter: 50 mm, angle of inclination: 1°) as temperature-controlled at 25° C. and held at 25° C. for 10 minutes, thereby preparing a "solution (α)" described in the aforementioned requirement (II). On that occasion, attention was paid such that a strain was not given to the inserted solution.

Then, a storage modulus (G') and a complex viscosity ($|\eta^*|$) of each of the solutions prepared so as to correspond to the aforementioned "solution ($\alpha$)" described in the aforementioned requirement (II) were measured in a vibration mode under conditions of a measuring temperature of 25° C., an angular frequency of 100 rad/s, and a strain of 20%. These results are shown in Table 1.

(4) Measurement 3: Measurement of Storage Modulus (G') and Complex Viscosity ($|\eta^*|$) of Each of Solutions (A) to (E) Prepared so as to Correspond to the Aforementioned "Solution ($\beta$)" at a Measuring Temperature of 25° C.

Using a rheometer "Physica MCR 301", manufactured by Anton Paar, the measurement was performed by the following procedures.

First of all, any one of the Solutions (A) to (E) as prepared by the foregoing (1) was inserted into a cone plate (diameter: 50 mm, angle of inclination: 1°) as temperature-controlled at 25° C., subjected to temperature rise to 100° C. at a temperature rise rate of 0.2° C./s, and then held at 100° C. for 10 minutes.

Thereafter, the resulting solution was quenched from 100° C. to 25° C. at a temperature drop rate of 0.2° C./s and held at 25° C. for 10 minutes, thereby preparing a "solution ($\beta$)" described in the aforementioned requirement (II). Attention was paid such that in all of the aforementioned temperature rise process, holding step at 100° C., and temperature drop process, a strain was not given to the inserted solution.

Then, a storage modulus (G') and a complex viscosity ($|\eta^*|$) of each of the solutions prepared so as to correspond to the aforementioned "solution ($\beta$)" described in the aforementioned requirement (II) were measured in a vibration mode under conditions of a measuring temperature of 25° C., an angular frequency of 100 rad/s, and a strain of 1%. These results are shown in Table 1.

In addition, from the values as measured by the aforementioned "Measurement 2" and "Measurement 3", the "ratio [($\beta$)/($\alpha$)] of storage modulus (G') of solution ($\beta$) to solution ($\alpha$)" and the "ratio [($\beta$)/($\alpha$)] of complex viscosity ($|\eta^*|$) of solution ($\beta$) to solution ($\alpha$)" were calculated. These values are also shown in Table 1.

Examples 1 to 2 and Comparative Examples 1 to 3, was added together with a 100N mineral oil, a pour-point depressant, and an additive package for engine oil of the blending amounts shown in Table 2, thereby preparing lubricating oil compositions whose SAE viscosity grade was "0W-20".

The blending amount of each of the "Solutions (A) to (E)" in Table 2 is an amount including not only each of the Viscosity Index Improvers (A-1) to (E-1) as a solid component but also the 100N mineral oil as the diluent oil, and a numerical value described in each of the parentheses expresses a blending amount of the viscosity index improver (solid component in each of the solutions).

Details of the "100N mineral oil", "Solutions (A) to (E)", "pour-point depressant", and "additive package for engine oil" as used in the present Examples and Comparative Examples are as follows.

100N mineral oil: A mineral oil having a kinematic viscosity at 40° C. of 17.8 $mm^2/s$, a kinematic viscosity at 100° C. of 4.07 $mm^2/s$, a viscosity index of 131, and a density at 15° C. of 0.824 $g/cm^3$, the base oil being classified into Group 3 of the base stock categories of the API.

Solutions (A) to (E): Solutions each containing 25 mass % of any one of the Viscosity Index Improvers (A-1) to (E-1) together with the 100N mineral oil, as prepared in Examples 1 to 2 and Comparative Examples 1 to 3, respectively.

Pour-point depressant: A polymethacrylate-based pour-point depressant having an Mw of 62,000.

Additive package for engine oil: An additive package in conformity with the API/ILSAC SN/GF-5 standards and containing the following various additives.

Metal-based detergent: Calcium salicylate (calcium atom content on a basis of the lubricating oil composition=2,000 ppm)

Dispersant: High-molecular weight bisimide and boron-modified monoimide

Anti-wear agent: Primary ZnDTP and secondary ZnDTP (phosphorus atom content on a basis of the lubricating oil composition: 800 ppm)

Antioxidant: Diphenylamine-based antioxidant and hindered phenol-based antioxidant

TABLE 1

| | | Example 1 Solution (A) | Example 2 Solution (B) | Comparative Example 1 Solution (C) | Comparative Example 2 Solution (D) | Comparative Example 3 Solution (E) |
|---|---|---|---|---|---|---|
| Properties of solution | Resin component concentration [mass %] | 25 | 25 | 25 | 25 | 25 |
| | Kind of viscosity index improver | (A-1) | (B-1) | (C-1) | (D-1) | (E-1) |
| | Mw of viscosity index improver | 480,000 | 420,000 | 250,000 | 230,000 | 200,000 |
| | Mw/Mn of viscosity index improver | 2.4 | 5.2 | 2.1 | 2.1 | 2.3 |
| Measurement 1 | Storage modulus (G') [Pa] | $2.31 \times 10^2$ | $1.77 \times 10^2$ | $3.85 \times 10^{-1}$ | $4.77 \times 10^{-1}$ | $1.05 \times 10^2$ |
| | Loss modulus (G") [Pa] | $1.74 \times 10^2$ | $2.09 \times 10^2$ | $1.21 \times 10^1$ | $3.11 \times 10^1$ | $2.98 \times 10^2$ |
| | Ratio [(G')/(G")] of storage modulus (G') to loss modulus (G") | 1.33 | 0.85 | 0.03 | 0.02 | 0.35 |
| Measurement 2 | Solution ($\alpha$): Storage modulus (G') [Pa] | $1.58 \times 10^1$ | $1.35 \times 10^1$ | $5.50 \times 10^{-1}$ | $1.13 \times 10^2$ | $1.22 \times 10^3$ |
| | Solution ($\alpha$): Complex viscosity ($|\eta^*|$) [Pa · s] | 0.79 | 1.10 | 0.32 | 3.40 | 14.10 |
| Measurement 3 | Solution ($\beta$): Storage modulus (G') [Pa] | $5.51 \times 10^2$ | $1.07 \times 10^2$ | 0.00 | $1.01 \times 10^2$ | $1.77 \times 10^3$ |
| | Solution ($\beta$): Complex viscosity ($|\eta^*|$) [Pa · s] | 6.44 | 2.75 | 0.40 | 3.42 | 19.80 |
| — | Ratio [($\beta$)/($\alpha$)] of storage modulus (G') of solution ($\beta$) to solution ($\alpha$) | 34.87 | 7.93 | 0.00 | 0.89 | 1.45 |
| | Ratio [($\beta$)/($\alpha$)] of complex viscosity ($|\eta^*|$) of solution ($\beta$) to solution ($\alpha$) | 8.15 | 2.50 | 1.25 | 1.01 | 1.40 |

Examples 3 to 4 and Comparative Examples 4 to 6

Any one of the Solutions (A) to (E) of the type and blending amount shown in Table 2, which were prepared in Defoaming agent: Silicone-based defoaming agent Then, with respect to the prepared lubricating oil compositions, the kinematic viscosities at 40° C. and 100° C., the viscosity index, the CCS viscosity at −35° C., the HTHS viscosity at 150° C., the density at 15° C., and the driving torque improving rate were measured according to the aforementioned measurement methods. The results are shown in Table 2.

TABLE 2

| | | Example 3 | Example 4 | Comparative Example 4 | Comparative Example 5 | Comparative Example 6 |
|---|---|---|---|---|---|---|
| Composition (parts by mass) | 100N mineral oil | 79.20 | 79.90 | 78.40 | 83.15 | 78.90 |
| | Solution (A) (containing 25 mass % of Viscosity Index Improver (A-1)) * | 8.60 (2.15) | — | — | — | — |
| | Solution (B) (containing 25 mass % of Viscosity Index Improver (B-1)) * | — | 7.90 (1.98) | — | — | — |
| | Solution (C) (containing 25 mass % of Viscosity Index Improver (C-1)) * | — | — | 9.40 (2.35) | — | — |
| | Solution (D) (containing 25 mass % of Viscosity Index Improver (D-1)) * | — | — | — | 4.65 (1.16) | — |
| | Solution (E) (containing 25 mass % of Viscosity Index Improver (E-1)) * | — | — | — | — | 8.90 (2.23) |
| | Pour-point depressant | 0.30 | 0.30 | 0.30 | 0.30 | 0.30 |
| | Additive package for engine oil | 11.90 | 11.90 | 11.90 | 11.90 | 11.90 |
| | Total | 100.00 | 100.00 | 100.00 | 100.00 | 100.00 |
| Physical properties | Kinematic viscosity at 40° C. ($mm^2/s$) | 27.8 | 29.0 | 30.3 | 33.2 | 30.0 |
| | Kinematic viscosity at 100° C. ($mm^2/s$) | 7.4 | 7.3 | 6.9 | 7.7 | 7.1 |
| | Viscosity index | 247 | 236 | 199 | 214 | 211 |
| | CCS viscosity at −35° C. (mPa · s) | 3800 | 3950 | 3900 | 3850 | 3800 |
| | HTHS viscosity at 150° C. (mPa · s) | 2.6 | 2.6 | 2.6 | 2.6 | 2.6 |
| | Density at 15° C. ($g/cm^3$) | 0.841 | 0.844 | 0.846 | 0.845 | 0.845 |
| | Driving torque improving rate (%, based on Comparative Example 4) | 0.6 | 0.2 | Basis | −1.9 | −0.2 |

* The numerical value described in each of the parentheses expresses a blending amount of the viscosity index improver (solid content in each of the solutions).

It is noted from Table 2 that since the lubricating oil compositions of Examples 3 to 4 contain the Viscosity Index Improver (A-1) or (B-1), each of which is the viscosity index improver according to the embodiment of the present invention, are favorable in the various physical properties and also have a high driving torque improving rate of "0.2% or more" in the case of comparing the lubricating oil composition of Comparative Example 4, so that they are a lubricating oil composition having an excellent fuel consumption reducing properties.

The invention claimed is:

1. A lubricating oil composition, comprising a viscosity index improver and a base oil, wherein:

the viscosity index improver comprises a comb-shaped polymer comprising a constituent unit (X1) derived from at least one polymeric macromonomer (x1) comprising a polymerizable functional group, wherein repeating units of the polymeric macromonomer (x1) are selected from the group consisting of a repeating unit of formula (i), a repeating unit of formula (ii), and mixtures thereof:

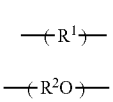

(i)

(ii)

$R^1$ represents a linear or branched chain alkylene group having a carbon number of 1 to 10;

$R^2$ represents a linear or branched chain alkylene group having a carbon number of 2 to 4;

a CCS viscosity of the lubricating oil composition at −35° C. is 4,000 mPa·s or less; and with respect to a solution having the viscosity index improver dissolved in a mineral oil and having a solid component concentration of 25 mass %, a ratio of a storage modulus G' to a loss modulus G" of the solution measured at a measuring temperature of 70° C., an angular frequency of 100 rad/s, and a strain of 20% is 0.40 or more.

2. The lubricating oil composition according to claim 1, wherein the storage modulus G' of the solution measured at a measuring temperature of 70° C., an angular frequency of 100 rad/s, and a strain of 20% is 1.2 x $10^2$ Pa or more.

3. A lubricating oil composition, comprising a viscosity index improver and a base oil, wherein:

the viscosity index improver, comprising a comb-shaped polymer comprising a constituent unit (X1) derived from at least one polymeric macromonomer (x1) comprising a polymerizable functional group, wherein repeating units of the polymeric macromonomer (x1) are selected from the group consisting of a repeating unit of formula (i), a repeating unit of formula (ii), and mixtures thereof:

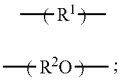

(i)

(ii)

$R^1$ represents a linear or branched chain alkylene group having a carbon number of 1 to 10;

$R^2$ represents a linear or branched chain alkylene group having a carbon number of 2 to 4;

a CCS viscosity of the lubricating oil composition at −35° C. is 4,000 mPa·s or less; and with respect to a solution α at 25° C. having the viscosity index improver dissolved in a mineral oil and having a solid component concentration of 25 mass % and a solution βresulting from heating the solution α to 100° C. at a temperature rise rate of 0.2° C/s and then cooling to 25° C. at a cooling rate of 0.2° C/s, a ratio of a storage modulus G' of the solution βmeasured at a measuring temperature of 25° C., an angular frequency of 100 rad/s, and a strain of 1% to a storage modulus G' of the solution α measured at a measuring temperature of 25° C., an angular frequency of 100 rad/s, and a strain of 20% is 2.0 or more.

4. The lubricating oil composition according to claim 1, wherein a weight average molecular weight Mw of the comb-shaped polymer is 10,000 to 1,000,000.

5. The lubricating oil composition according to claim 1, wherein a molecular weight distribution Mw/Mn of the comb-shaped polymer, where Mw represents a weight average molecular weight of the foregoing comb-shaped polymer and Mn represents a number average molecular weight of the comb-shaped polymer, is 8.00 or less.

6. The lubricating oil composition according to claim 1, wherein the comb-shaped polymer is a copolymer comprising:

the constituent unit (X1) derived from the macromonomer (x1); and a constituent unit (X2) derived from a monomer (x2) selected from the group consisting of a monomer (x2-a) represented by the following general formula (al), an alkyl (meth)acrylate (x2-b), a nitrogen atom-containing vinyl monomer (x2-c), a hydroxyl group-containing vinyl monomer (x2-d), an aliphatic hydrocarbon-based vinyl monomer (x2-e), an alicyclic hydrocarbon-based vinyl monomer (x2-f), a vinyl ester (x2-g), a vinyl ether (x2-h), a vinyl ketone (x2-i), an epoxy group-containing vinyl monomer (x2-j), a halogen element-containing vinyl monomer (x2-k), an ester of unsaturated polycarboxylic acid (x2-1), a (di)alkyl fumarate (x2-m), and a (di)alkyl maleate (x2-n):

(al)

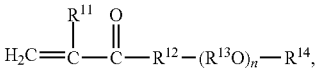

wherein:

$R^{11}$ represents a hydrogen atom or a methyl group;

$R^{12}$ represents a single bond, a linear or branched chain alkylene group having a carbon number of 1 to 10, —O—, or —NH—;

$R^{13}$ represents a linear or branched chain alkylene group having a carbon number of 2 to 4;

n represents an integer of 1 or more;

in the case where n is an integer of 2 or more, plural $R^{13}$s may be the same as or different from each other, and furthermore, the $(R^{13}O)_n$ moiety may be either a random bond or a block bond; and $R^{14}$ represents a linear or branched chain alkyl group having a carbon number of 1 to 60.

7. The lubricating oil composition according to claim 1, wherein a content of a solid component of the viscosity index improver is 0.01 to 15.0 mass % on a basis of a total amount of the lubricating oil composition.

8. The lubricating oil composition according to claim 1, further comprising at least one additive for lubricating oil selected from the group consisting of a pour-point depressant, a metal-based detergent, a dispersant, an anti-wear agent, an extreme pressure agent, an antioxidant, and an anti-foaming agent.

9. The lubricating oil composition according to claim 1, wherein the base oil is at least one selected from the group consisting of a mineral oil classified into Group 2 or Group 3 of base stock categories of the American Petroleum Institute and a synthetic oil.

10. The lubricating oil composition according to claim 1, wherein a high temperature high shear viscosity at 150° C. is 1.4 to 3.5 mPa·s.

11. The lubricating oil composition according to claim 1, wherein a kinematic viscosity at 100° C. is 3.0 to 12.5 $mm^2/s$.

12. The lubricating oil composition according to claim 1, wherein a viscosity index is 120 or more.

13. A method for producing the lubricating oil composition of claim 1, the method comprising blending the base oil with the viscosity index improver.

14. The lubricating oil composition according to claim 3, wherein a weight average molecular weight Mw of the comb-shaped polymer is 10,000 to 1,000,000.

15. The lubricating oil composition according to claim 3, wherein a molecular weight distribution Mw/Mn of the comb-shaped polymer, where Mw represents a weight average molecular weight of the foregoing comb-shaped polymer and Mn represents a number average molecular weight of the comb-shaped polymer, is 8.00 or less.

16. The lubricating oil composition according to claim 3, wherein the comb-shaped polymer is a copolymer comprising:

the constituent unit (X1) derived from the macromonomer (x1); and a constituent unit (X2) derived from a monomer (x2) selected from the group consisting of a monomer (x2-a) represented by the following general formula (al), an alkyl (meth)acrylate (x2-b), a nitrogen atom-containing vinyl monomer (x2-c), a hydroxyl group-containing vinyl monomer (x2-d), an aliphatic hydrocarbon-based vinyl monomer (x2-e), an alicyclic hydrocarbon-based vinyl monomer (x2-f), a vinyl ester (x2-g), a vinyl ether (x2-h), a vinyl ketone (x2-i), an epoxy group-containing vinyl monomer (x2-j), a halogen element-containing vinyl monomer (x2-k), an ester of unsaturated polycarboxylic acid (x2-l), a (di)alkyl fumarate (x2-m), and a (di)alkyl maleate (x2-n):

(al)

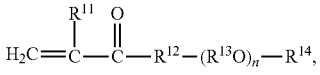

wherein:

$R^{11}$ represents a hydrogen atom or a methyl group;

$R^{12}$ represents a single bond, a linear or branched chain alkylene group having a carbon number of 1 to 10, —O—, or 13 NH—;

$R^{13}$ represents a linear or branched chain alkylene group having a carbon number of 2 to 4;

n represents an integer of 1 or more;

in the case where n is an integer of 2 or more, plural $R^{13}$s may be the same as or different from each other, and furthermore, the $(R^{13}O)_n$ moiety may be either a random bond or a block bond; and $R^{14}$ represents a linear or branched chain alkyl group having a carbon number of 1 to 60.

17. The lubricating oil composition according to claim 3, wherein a content of a solid component of the viscosity index improver is 0.01 to 15.0 mass % on a basis of a total amount of the lubricating oil composition.

18. The lubricating oil composition according to claim 3, further comprising at least one additive for lubricating oil selected from the group consisting of a pour-point depressant, a metal-based detergent, a dispersant, an anti-wear agent, an extreme pressure agent, an antioxidant, and an anti-foaming agent.

19. The lubricating oil composition according to claim 3, wherein the base oil is at least one selected from the group consisting of a mineral oil classified into Group 2 or Group 3 of base stock categories of the American Petroleum Institute and a synthetic oil.

20. The lubricating oil composition according to claim 3, wherein a high temperature high shear viscosity at 150° C. is 1.4 to 3.5 mPa·s.

21. The lubricating oil composition according to claim 3, wherein a kinematic viscosity at 100° C. is 3.0 to 12.5 $mm^2/s$.

22. The lubricating oil composition according to claim 3, wherein a viscosity index is 120 or more.

23. A method for producing the lubricating oil composition of claim 3, the method comprising blending the base oil with the viscosity index improver.

* * * * *